United States Patent [19]

Avery

[11] Patent Number: 4,976,276

[45] Date of Patent: Dec. 11, 1990

[54] PORTABLE HAIR STYLER

[76] Inventor: Allison Avery, 2902 Glen Canyon Rd., Santa Cruz, Calif. 95060

[21] Appl. No.: 472,076

[22] Filed: Jan. 30, 1990

[51] Int. Cl.[5] ..... A45D 7/02

[52] U.S. Cl. ..... 132/212; 132/270

[58] Field of Search ..... 132/270, 271, 212, 333

[56] References Cited

U.S. PATENT DOCUMENTS

| | | | |
|---|---|---|---|
| 998,804 | 7/1911 | Salisbury | 132/212 X |
| 1,720,302 | 7/1929 | Suter | 132/212 X |
| 3,948,379 | 4/1976 | Warner | 132/212 X |
| 4,433,492 | 2/1984 | Santa Lucia | 132/212 X |
| 4,759,135 | 7/1988 | Scivoletto | 132/212 X |

*Primary Examiner*—Gene Mancene

*Assistant Examiner*—R. Thomas Price

*Attorney, Agent, or Firm*—Jeffrey A. Hall

[57] ABSTRACT

A portable hair styling tool, particularly useful with a hand-held hair drying unit or the like, wherein the hair styling tool is shaped and adapted for placement on the user's head comprising a styling bowl with conical projections having apertures therethrough so as to focus the heated air emanating from the drying unit. The hair styling member is, in one embodiment, a styling bowl shaped member with a base, a handle, and a plurality of styling cones with holes therethrough concentrated in the central portion of the dish to hold, form, separate, and style the hair into waves and curls. In other embodiments, the styling cones are distributed throughout the styling bowl.

9 Claims, 2 Drawing Sheets

PORTABLE HAIR STYLER

BACKGROUND OF THE INVENTION

1. Field of Invention

This invention relates to hair styling devices, and especially to hair styling devices for use in scrunching and "natural" styling of hair, and for performing a wide variety of other functions.

2. Description of the Prior Art

Many, if not most hair stylists and consumers of hair styling products prefer to hold, form, separate, and style hair in a "natural," "permanent" or scrunched mode while it is being dried by a hand-held blow dryer.

Heretofore a wide variety of hair styling devices have been proposed and implemented for styling hair.

One such hair styling device consisted of a hair net stretched over a frame and a cylindrical handle that is gripped with one hand. Users regarded this type of hair styling device as unsatisfactory for hair styling especially for modern hair styles because its use was limited to holding pre-set hair in place while hair spray or other treatment was applied to the hair. Users found this type of styling device incapable of holding, forming, and separating the hair into waves or curls which current fashion demands. In essence, users found this type of hair styling device unsatisfactory because it is unusable for the demanding applications required of a modern hair styling device.

Another type of hair styling device comprised a hair dryer insert functioning as a fluid diffusion hood where users inserted it into the hood of a hair dryer so that the heated air emanating from the dryer did not disrupt the hairdo. However, this type of styling device was limited in its styling applications because it could not hold or style the hair, nor was it capable of scrunching the hair as current fashion demands. This type of diffusion hood simply diffused the flow of heat from the dryer. It was not capable of holding, forming, and separating the hair into waves or curls either in the "natural," or "permanent" styles.

With the "natural," "permanent," and scrunched hair styles in fashion today, it is necessary to employ heat lamps or dryers in conjunction or combination with hair rollers, pins, clips and the like, in order to form and separate the hair into the waves and curls characteristic of these styles.

Portable hair dryers have been in existence for many years. Traditionally, they have included bonnets made of fabric or other sheet material. The bonnet is fitted over the head and means are provided for introducing a supply of heated air to and through the interior of the bonnet so as to pick up moisture from and dry the hair.

Another, more recent form of instrument has come into use. Rather than having a bonnet, this device is designed to be used for localized, or "spot" drying. This is a hand-held unit and is ordinarily employed in conjunction with styling the hair. The hand-held units of this type produce a small stream of heated air and are not ordinarily used for drying the entire hair mass. However, the task of holding, forming, and separating the hair into a desired form must be accomplished with the aid of hair rollers, pins, clips, or squeezing and pinching the hair into place, commonly referred to as scrunching.

Most users, therefore, would find it desirable to have a hair styling tool which could hold and facilitate the formation of waves and curls in the hair at the same time that the hair is being dried by a hand-held dryer without the concomitant need for hair rollers, pins, clips, or the squeezing and pinching of the hair known as scrunching widely used by hair stylists today.

SUMMARY OF THE INVENTION

It is an object of the invention to provide a hand-held hair styling tool that is easily, reliably, and neatly used in combination with hand-held hair drying devices wherein the hair styling tool holds, forms, separates, and styles the hair while it is being dried.

It is another object of the invention to provide a hand-held hair styling tool for use with hair dryers and the like, that eliminates the need to squeeze and pinch the hair in order to obtain a scrunched style.

It is still another object of the invention to provide a hand-held hair styling tool that significantly reduces the time required to dry the hair.

It is a further object of the invention to provide a hair styling tool that reduces the frizzy appearance of the hair that often results from using a hand-held hair dryer.

It is a still further object of this invention to provide a hair styling tool that frees the stylists hands from the direct flow of heated air from a hand-held hair drying unit.

It is an additional object of this invention to provide a hair styling tool for hair styling and the like, wherein the tool is light-weight, requires a minimum of skill and training to use, and is extremely reliable.

It is another object of the invention to provide a hair styling tool that can be used on all types of hair and head shapes.

It is still another object of this invention to provide such a hair styling tool that can be easily adjusted for a variety of different styling requirements.

In an exemplary embodiment, this invention is directed to a hand-held hair styling member for use with hand-held hair drying units comprising a lightweight material shaped and adapted for placement on the head with a plurality of conical projections with holes therethrough sufficient to satisfactorily diffuse the heated air emanating from the hand-held drying unit thereby shaping and separating the hair while it is being dried.

These, and further objects and advantages will become apparent from a consideration of the ensuing description and accompanying drawings.

DRAWING REFERENCE NUMERALS

Figure 1:
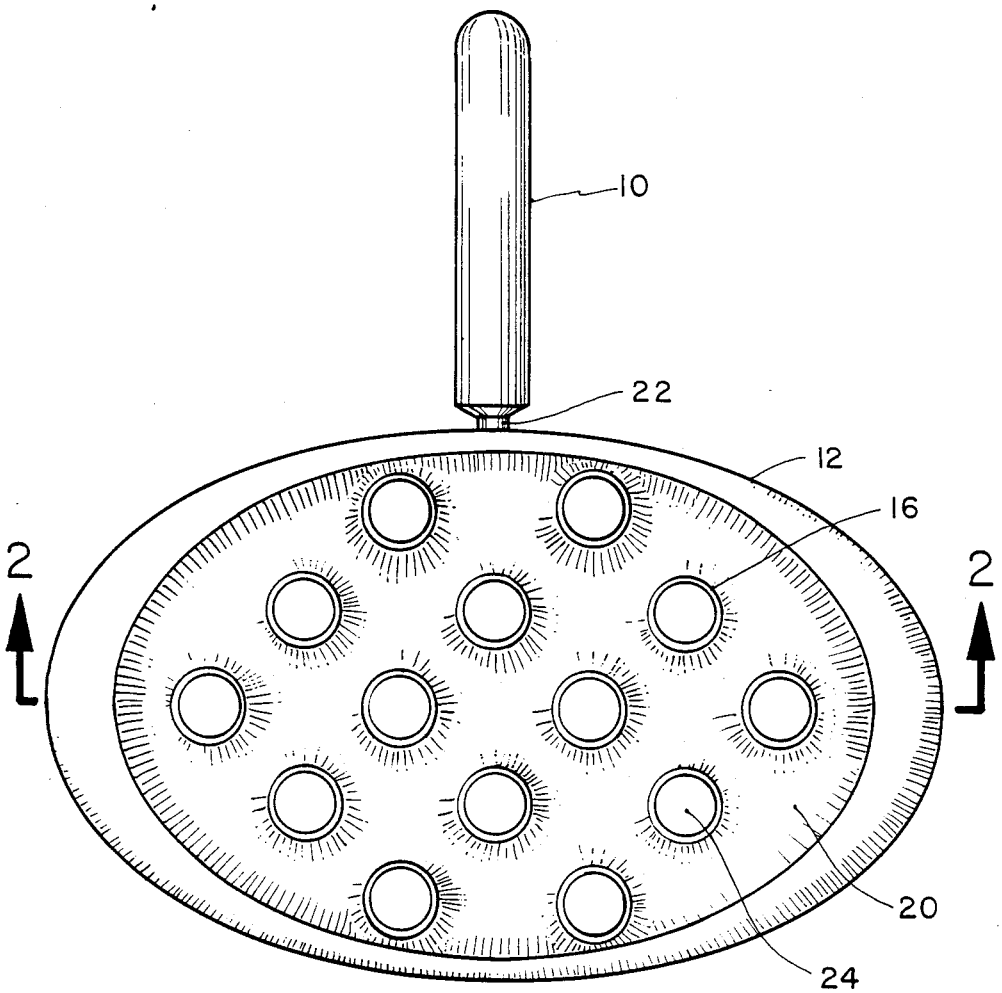
FIG. 1 shows a top view of a portable hair styler according to the invention.

10 handle
12 frame
16 styling cones
18 base
20 styling bowl
22 frame end portion
24 styling cone apertures

DESCRIPTION OF THE PREFERRED EMBODIMENT OF THE INVENTION

FIG. 1 shows a portable hair styler according to the preferred embodiment of the invention. The hair styler comprises a handle 10 which is preferably made of plastic and secured to frame 12 which terminates in juxtaposed end portion 22 which lies in a plane formed by the circular portion of the frame. Frame 12 is formed into a generally circular configuration. By this arrangement, a convenient means for gripping and handling the styler is provided.

Figure 2:
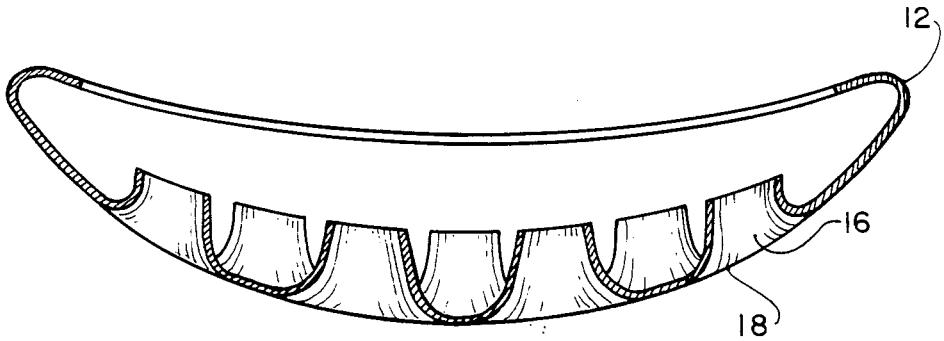
FIG. 2 shows a sectional view through 2—2 of such portable hair styler.

Secured to the periphery of frame 12 so as to extend across the area formed within the circular portion thereof is a styling bowl 20 which is a shallow bowl shaped member of lightweight material readily adapted to conform to the head of the user. FIG. 2 shows an end sectional view of the styling bowl 20 with base 18 and a plurality of conical projections forming styling cones 16 molded and integrally formed with the base. The cones 16 may be of various shapes, for example, funnel shape, chimney shape, or pyramidal shape.

Figure 3:
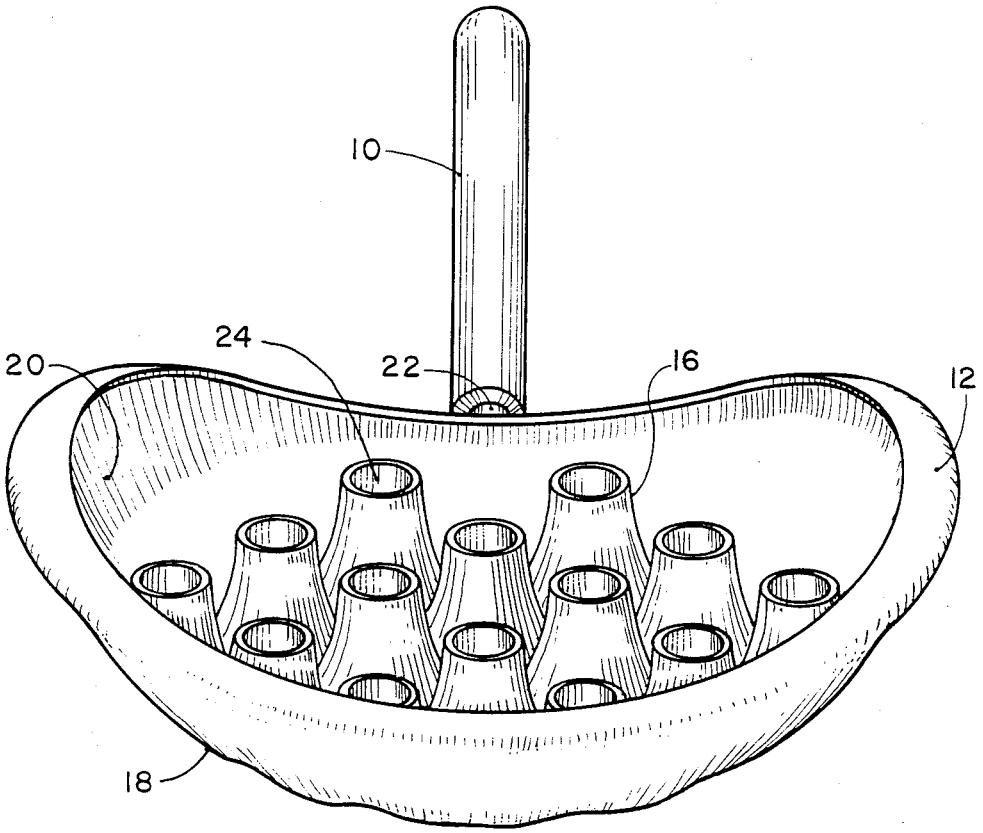
FIG. 3 shows an elevational, perspective of such portable hair styler, illustrating holes and cone construction.

Referring now to FIG. 3 the manner in which styling dish 20 is positioned with respect to the frame 12 will be seen more clearly. As shown, the styling bowl 20 is positioned and attached to the periphery of the frame 12. The styling bowl 20 is molded and integrally formed with frame 12 and shaped in a shallow bowl-like configuration so as to readily adapt to the user's head. Spaced throughout the styling bowl 20 are styling cones 16 having styling cone apertures 24 allowing for air flow therethrough for various purposes. In the preferred embodiment the styling cones 16 are spaced throughout the central area of the styling bowl 20 with a wider end of the cone 16 molded to the base 18 and a smaller end opening on the inside open surface of styling bowl 20. Different sized and spaced styling apertures 24 and styling cones 16, respectively, may be used for different styling effects. For example, smaller and more numerous apertures 24 in place of styling cones 16 may handle the same air flow at higher velocities thus providing more penetration of heated air to the hair mass if so desired.

In operation and with reference first to FIG. 3 styling cones 16 facilitate styling and scrunching of the user's hair. In addition to focusing air flow the styling cones 16 also may be utilized as a combing device, acting as large teeth of a comb, wherein by moving styling dish 20 to push the hair back, the styling cones 16 move hair along the scalp and hold it in place while drying. Alternatively, the styling cones 16 may be manipulated to push the hair backwards away from the face and then forward to form a protruding wave of hair around the face.

In another mode of operation the user simply leans forward allowing approximately one half of their hair to fall into styling bowl 20 and then moves the styling bowl 20 by maneuvering handle 10 so that the hair is enclosed and pushed against the scalp. The user then focuses a hand-held dryer towards base 18 and drys the hair, preferably taking 50–70% of moisture out of hair for a scrunched look. The same action may then be repeated on the other half of the hair. In this manner a scrunched look is achieved without concomitant manual squeezing and pinching of the hair and without the use of hair rollers, pins, clips, or the like. Many variations in operation of the hair styling device as shown in FIG. 1–3 are possible. With such device it is possible to hold, form, and separate the hair into waves and curls either in the "natural," "permanent," or scrunched styles. The use of such hair styler is especially useful to facilitate fashioning the scrunched look without manual manipulations of the hair.

Users will find the hair styling device of FIG. 1–3 additionally advantageous since it can be easily adapted for use in creating numerous hair shapes and styles. Users will also find the styler convenient because it is easy to store, carry, and use.

While the above description contains many specificities, the reader should not construe these as limitations on the scope of the invention, but merely as exemplifications of preferred embodiments thereof. Those skilled in the art will envision many other possible variations are within its scope. For example, skilled artisans will readily be able to change the dimensions and shapes of the various embodiments. They can make the styling cones in various shapes such as funnels or pyramids. They will also be able to make the hair styling device out of alternative materials such as various plastics and urethanes. They can make many variations on the shape and means of attaching the handle to the styling bowl of FIG. 1–3. They can double the bowl to form a hood-like hair styler that would be basically two hair stylers attached together (one for each half of the head). As an alternative to the foregoing, they can alter the dimensions and angle of attachment of the handle to the hair styler frame. They can form the hair styler by extrusion or machining so that it is a one piece unit. In fact they can provide any type of styling cone and aperture spacing and dimensions. Accordingly, the reader is requested to determine the scope of the invention by the appended claims and their legal equivalents, and not by the examples which have been given.

I claim:

1. A portable hair styler adapted to be applied against a selected portion of a human head to hold and position the hair in place during a drying application, comprising:

an elongated handle, a substantially circular frame member attached to said handle, and a styling bowl having an opening to the interior thereof and being adapted to permit the insertion of at least a portion of a person's head in the interior thereof and being composed of a lightweight material having a plurality of conical projections with apertures therethrough, said styling bowl being molded and shaped for cooperative association with said circular frame, whereby said plurality of conical projections focus heated air from a hair dryer to form, separate, and style the hair into waves and curls.

2. The hair styler of claim 1 wherein said styling bowl is constructed with a thickened base to add further strength and rigidly to the styling bowl.

3. A portable hair styler for use with portable hair dryers, comprising:

a perforated styling bowl having an opening to the interior thereof, said opening being selected to permit the insertion of at least a portion of a person's head in the interior thereof, a thickened base integrally molded onto said styling dish, a plurality of conical projections with holes therethrough being integrally molded and formed to said styling bowl, a circular frame member of thin pliable material molded onto the periphery of the styling bowl, and an elongated handle secured to the frame member and extending generally away from said frame member.

4. A hair styler for scrunching hair of use in combination with a portable hair dryer comprising:

an elongated handle, a shallow bowl shaped hair styling member having an opening to the interior thereof said opening being selected to permit the insertion of at least a portion of a person's head in the interior thereof, said bowl is secured to said handle, and a plurality of conical projections with apertures therethrough integrally molded and formed within said hair drying member, wherein said conical projections serve to transmit and focus heated air from a hair dryer onto the hair thereby forming and drying the hair into a desired style.

5. The hair styler of claim 4 wherein said conical projections are funnel shaped.

6. The hair styler of claim 4 wherein said hair styler is heat resistant, and is composed of molded material of sufficient strength to make said shallow bowl shaped hair styling member freestanding.

7. The hair styler of claim 4 wherein said bowl shaped styling member includes a circular frame member molded thereto.

8. The hair styler of claim 4 wherein said bowl shaped hair styling member is composed of plastic about one quarter to one half inch wall thickness.

9. The hair styler of claim 4 wherein said bowl shaped hair styler member is composed of molded polyurethane foam about one quarter to one half inch wall thickness.

* * * * *